United States Patent [19]

Ortemond

[11] 4,307,785

[45] Dec. 29, 1981

[54] PILE DRIVING RIG HAVING ANGULATING KNUCKLE LEAD THEREFOR

[76] Inventor: Leon D. Ortemond, Rte. 2, Box 148-B, Abbeville, La. 70510

[21] Appl. No.: 900,800

[22] Filed: Apr. 27, 1978

Related U.S. Application Data

[63] Continuation-in-part of Ser. No. 765,918, Feb. 7, 1977, Pat. No. 4,144,940.

[51] Int. Cl.[3] ..... E21B 15/04; E21B 7/36; E02D 9/00

[52] U.S. Cl. ..... 173/43; 175/9; 405/228

[58] Field of Search ..... 173/42, 43, 44; 175/9; 405/228, 232

[56] References Cited

U.S. PATENT DOCUMENTS

| | | | |
|---|---|---|---|
| 2,998,856 | 9/1961 | Larsen et al. | 173/43 |
| 3,328,969 | 7/1967 | Murphy et al. | 61/535 |
| 3,451,493 | 6/1969 | Storm | 175/9 |
| 3,474,629 | 10/1969 | Woodson | 175/9 X |
| 3,511,320 | 5/1970 | Miller | 173/43 |
| 3,539,024 | 11/1970 | Irons et al. | 175/85 |
| 3,550,693 | 12/1970 | Bermingham | 173/43 |
| 3,710,876 | 1/1973 | Christensen | 173/43 |
| 3,734,435 | 5/1973 | Frederick | 248/2 |
| 3,751,930 | 8/1973 | Mott et al. | 61/46.5 |
| 3,754,403 | 8/1973 | Mott et al. | 61/46.5 |
| 3,768,575 | 10/1973 | McKinnon et al. | 173/43 |
| 3,888,317 | 6/1975 | Walters | 173/43 |
| 4,102,094 | 7/1978 | MacKinnon | 173/43 X |

FOREIGN PATENT DOCUMENTS

| | | | |
|---|---|---|---|
| 615008 | 5/1935 | Fed. Rep. of Germany | 173/43 |
| 201573 | 2/1966 | Sweden | 173/43 |

*Primary Examiner*—Lawrence J. Staab
*Attorney, Agent, or Firm*—Bernard A. Reiter

[57] ABSTRACT

An Angulating Knuckle Lead installed within an offshore pile driving rig having both upper and lower hydraulically actuated supporting kickers, independently operable for driving pile on extreme slope or batter and which is movable upwardly and downwardly through an opening in the upper deck of the rig toward the lower deck.

14 Claims, 9 Drawing Figures

PILE DRIVING RIG HAVING ANGULATING KNUCKLE LEAD THEREFOR

This application is a continuation-in-part of my earlier filed copending application bearing Ser. No. 765,918, entitled "Method and Apparatus For Installing an Off Shore Driving Rig" filed on Feb. 7, 1977, now U.S. Pat. No. 4,144,940.

BACKGROUND OF THE INVENTION

It is well known in the art that the supporting structure for pile driving hammers may be angularly positioned so as to drive pile on a slope or batter. Commonly, this is accomplished through the use of various apparatus for tilting the frame in which the hammer is supported. This frame frequently is supported by the boom of a crane such as in U.S. Pat. Nos. 3,734,435 and 3,888,317. Such cranes and their angularly disposed booms occupy substantial space and are not readily adapted to disposition on offshore platforms where space is limited; but the need for pile driving operations nevertheless is present. Frequently such pile driving operations are carried on offshore by disposing the crane and angulated boom on a derrick barge or the like. In such situation, there is no space occupied on the deck of the platform itself, but the derrick barge is very expensive to use. However, as disclosed in my earlier filed application, Ser. No. 765,918, there is shown a method for establishing a movable pile driving rig on the platform itself in order to drive pile and conductor pipe in a predetermined pattern and in the absence of a derrick barge or the like. In that case, it becomes imperative to occupy as little space as possible on the deck of the platform, while at the same time providing for angular adjustment of the lead over a broad range of angles.

Driving operations are commonly carried out from the upper deck of an offshore rig. The upper deck stands a substantial height above the water, as much as sixty feet or more. Therefore, the hammer can drive the pipe only to the level of the upper deck. The structural configuration of the rig further provides for a lower deck, frequently known as the cellar deck, this deck being commonly at a level or forty or more feet above the water. Also, there may be a jacket level proximate the surface of the water at perhaps ten or so feet above. Boat bumpers are frequently attached at the jacket level so that service vessels can tie up to the rig. Since the hammer can drive pile and pipe only to the upper deck, there frequently exists a residual length of pipe above the water after the pile or pipe has been driven to depth this being due to the fact that the hammer can only operate to the level of the upper deck. Therefore, the residual length of pipe must be cut off at some predetermined level in order to attach a Christmas tree or other production equipment. The cutting step is time consuming and, therefore, expensive.

THE INVENTION

Accordingly, the present invention provides for an advantageous structure in the form of a pile driving rig having an extensible knuckle lead therein capable of adjustment to from full batter to extreme angles of inclination which may be either positive or negative angles with respect to the vertical end without tilting the rig, that is the rig or boom supporting the lead.

Another advantage of the invention resides in a full hydraulically powered knuckle lead adjustment system, thus eliminating cables and their operational maintenance problems.

Another feature of the invention resides in the use of upper and lower kicker means.

Yet another feature and advantage of the invention resides in the use of new and improved kicker mechanisms both at the upper and lower end of the knuckle lead for selectively adjusting the knuckle lead within the pile driving rig either at the top or bottom thereof.

A further feature and advantage of the invention resides in provision for a knuckle lead support and adjustment system capable of angular inclination independently from either of two (2) points and within a vertically fixed tower or rig.

Still a further feature and advantage of the invention resides in a new and improved kicker mechanism providing for universal adjustment of the knuckle lead at both the top and bottom thereof.

A further feature and advantage of the invention resides in a provision for a knuckle lead which is adjustably positioned with respect to the water surface and can therefore move upwardly or downwardly through the upper deck of a rig.

A further feature and advantage of the invention resides in a knuckle lead which is movable upwardly or downwardly through the upper deck of a rig in order to drive a residual length of pipe or pile to depth.

A still further feature and advantage of the invention resides in a knuckle lead which is movable upwardly or downwardly through a hole in the upper deck of a rig in order to drive a residual length of pile or pipe to depth and to thus avoid the step of cutting such residual length.

A further feature and advantage of the invention resides in provision for a knuckle lead for carrying a pile driving hammer which is movable upwardly or downwardly through the upper deck of an offshore rig to the level of the lower deck or below thus minimizing joint cutting and welding and producing more economical hammering operations.

A still further feature and advantage of the invention resides in provision for a knuckle lead for carrying a pile driving hammer which is movable upwardly or downwardly from the lower deck, or even the jacket level of an offshore rig thus enabling the use of longer pipe and longer pile driving periods and minimizing welding time and resulting in more economical hammering operations.

These and numerous features and advantages of the invention will become more readily apparent upon a detailed reading of the following specification, claims and drawings, wherein like numerals denote like parts in the several views and wherein:

IN THE DRAWINGS

DESCRIPTION OF THE PREFERRED EMBODIMENT

Figure 1:
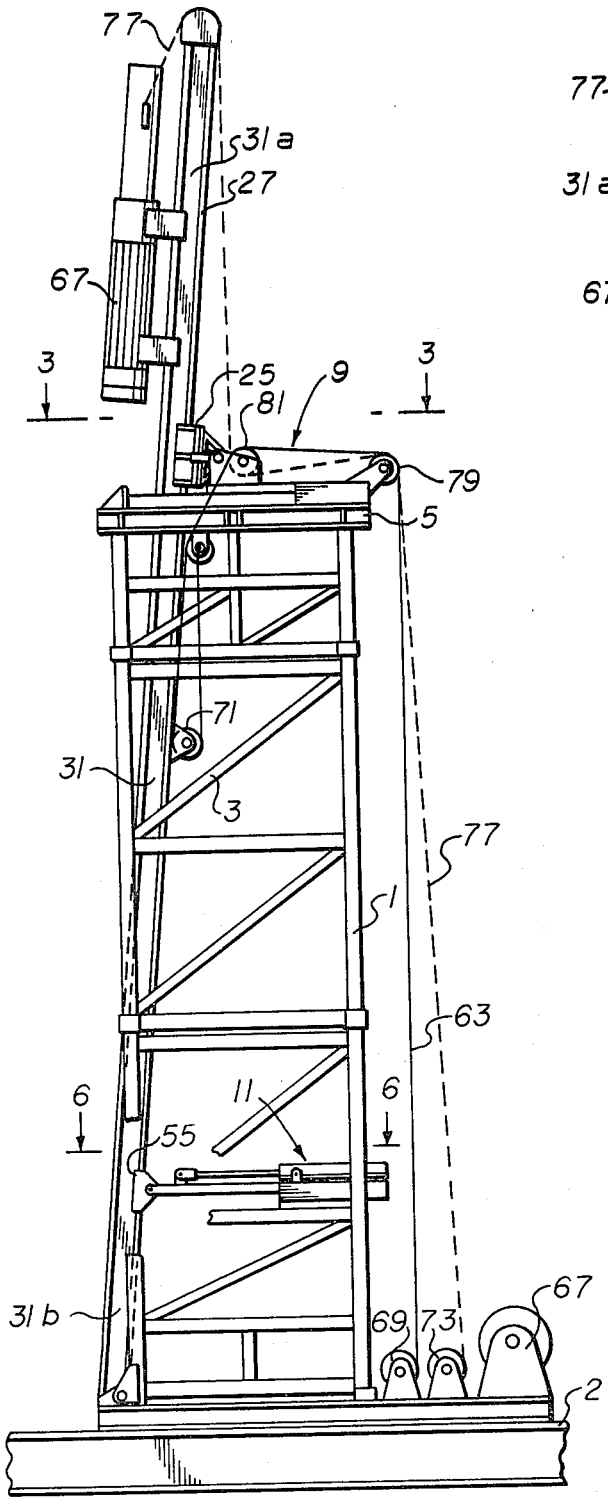
FIG. 1 is a side view of the pile driving rig showing the hammer and knuckle lead in a first operating position at a positive angle of batter.

The invention here pertains to a system for selectively controlling, in economical manner, the angle of inclination of a pile hammer lead from an extensible to retractable batter positions. The pile driving rig in which the lead is supported is itself selectively movable over a pattern of skid track means 2 or the like, see FIG. 1, on the platform and as disclosed in the aforementioned Application. The rig consists of a structural tower arrangement consisting of vertical frame members 1 interconnected with diagonal braces 3, welded or otherwise structurally fastened to one another to form a derrick like rig which is supported on the aforementioned skid beams at the bottom and which terminates at the top thereof in the head plate 5. Structurally affixed to and supported by the head plate 5 is the upper kicker assembly 9 which includes the pulley arrangement for raising the knuckle lead, described hereinafter. Structurally affixed to and supported by the frame members 1 of the rig and at the lower end thereof proximate the skid beams is the lower kicker assembly 11. The lower kicker assembly and the upper kicker assembly 11, 9 respectively, though structurally affixed and supported by the rig, as previously explained, are characterized by an expansible-retractable means, such as a piston and cylinder arrangement, which is coupled to slide members that engage opposing tracks of the knuckle lead.

Figure 4:
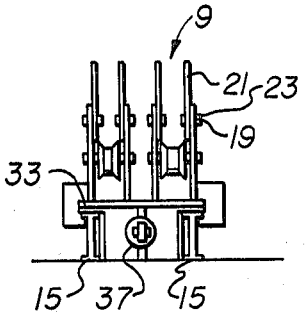
FIG. 4 is an end view of FIG. 3 along the plane 4—4 thereof.
Figure 5:
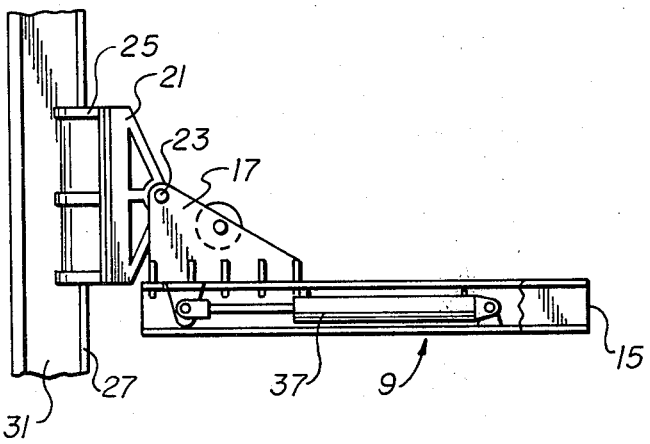
FIG. 5 is a side view of FIG. 3.
Figure 6:
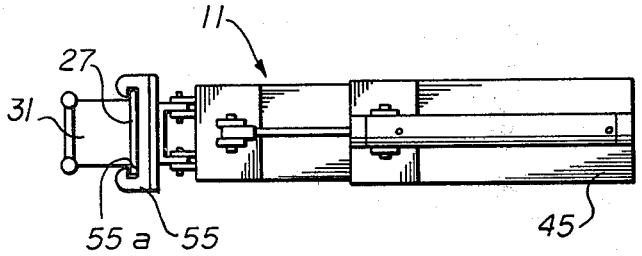
FIG. 6 is a top view of the lower kicker along the plane 6—6 of FIG. 1.
Figure 7:
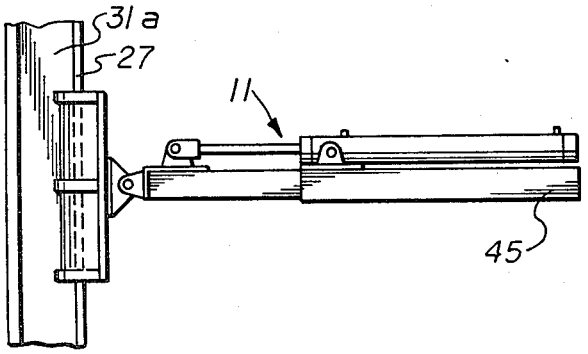
FIG. 7 is a side view of FIG. 6.

More specifically with reference to FIGS. 1 and 4, there is shown the upper kicker assembly 9 which comprises a parallel support beams 15 structurally affixed to the head plate at a predetermined distance from one another. Affixed to the end of each support beam 15 is a trunnion plate 17 having an alligned bore 19 in the upper end thereof. A yoke plate 21 is characterized by a plurality of integral reenforcing plates 21*a* and 21*b* each having bores alligned with the bore 19 in trunnion plate 17 so that upon insertion of the pins 23 there is provided a pivotal connection for yoke plate 21 with respect to trunnion plate 17. The yoke plate 21 is adapted to carry slide means 25 having a recess 25*a* which receives the flange 27 of knuckle lead 31. The trunnion plate 17 includes supporting plate 33 which is adapted to slide on the surface of support beams 15 upon actuation of the piston and cylinder means 37 which is affixed to its inner end to the head plate, and at the opposing end to the trunnion plate so as to thereby cause movement of the upper end 31*a* of knuckle 31 in the plane of movement of the piston.

Similarly, there is connected at the lower end 31*b* of the knuckle lead the lower kicker assembly means 11 comprising a second piston and cylinder means 45 which is structurally affixed to and carried by the frame of the pile driving rig. Slidably received within the cylinder is the piston portion characterized by a pivotal connection at the end thereof to a second slide means 57. The slide means 57 is, like the slide means 25, characterized by opposing recesses 55*a* adapted to receive the flange 27 of knuckle lead 31. Thus, upon actuation of the piston and cylinder means 45, the lower section 31*b* of the knuckle lead is caused to move toward or away from the cylinder in the plane of movement of the piston.

Figure 9:
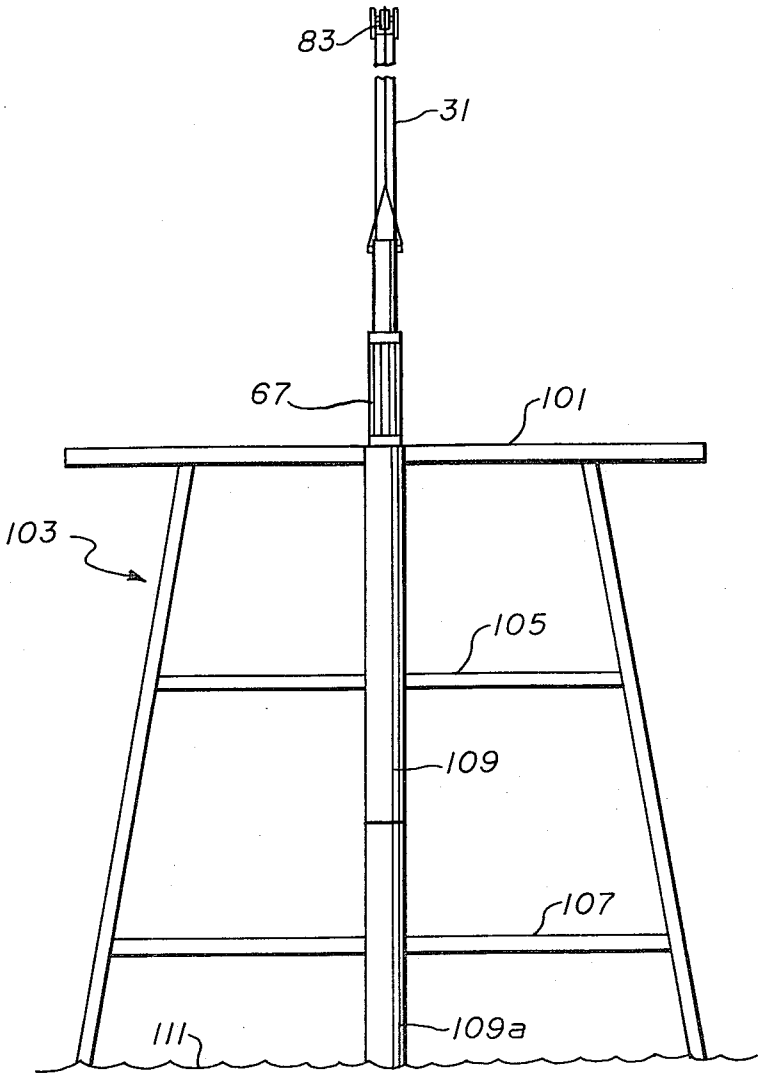
FIG. 9 is an elevation view of an offshore platform like that of FIG. 8 showing the pile driving rig operating at the level of the upper deck as is commonly done.
Figure 8:
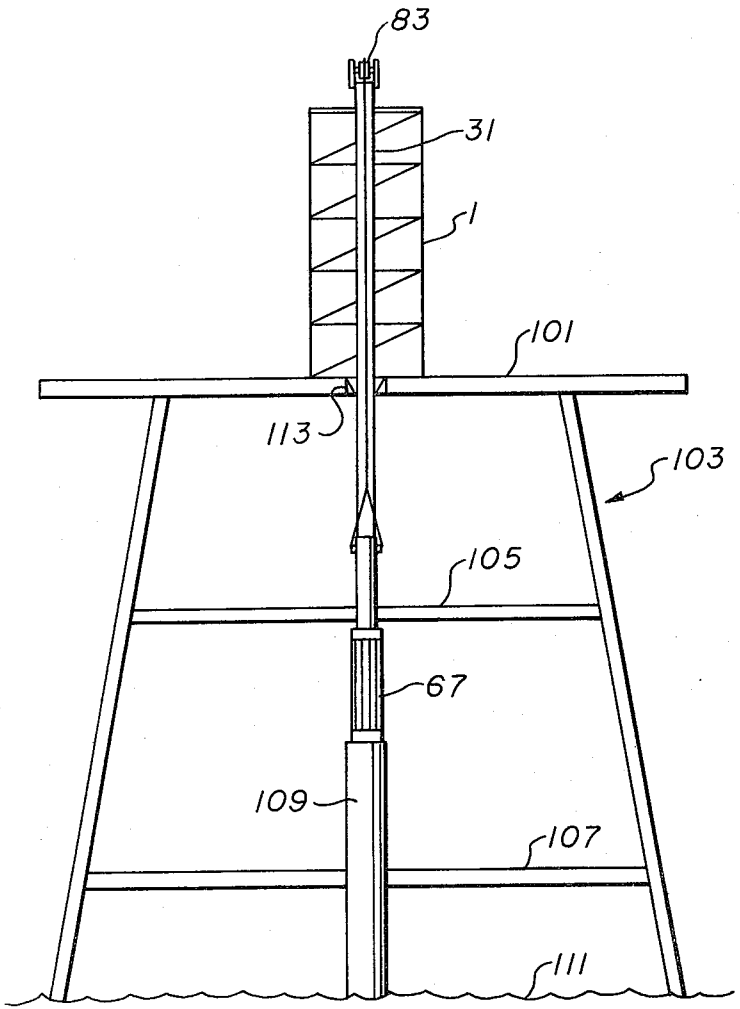
FIG. 8 is an elevation view of an offshore platform having a pile driving rig thereon and showing the adjustable knuckle lead with the pile driving hammer operating at the level of the lower deck.

With reference to FIG. 8, there is shown the tower frame members 1 generally supported on tract means (not shown) which in turn rest upon the upper deck 101 of the rig 103. The rig further is characterized by a lower or cellar deck 105 and a jacket level 107 which commonly carries both bumpers and at which level service vessels tie up for loading and off-loading equipment and supplies from the rig 103. Supported within the frame members 1 is the aforedescribed knuckle lead 31 which is movable in accordance with the mechanics providing for the decrees of freedom as previously described. Operation of a conventional knuckle lead, as shown in FIG. 9, allows for hammering operations to take place above or at the level of upper deck 101 such that when pipe or pile joint 109 is driven to the level of deck 101 another joint like that of 109 must be hoisted to the level of the upper deck 101, carefully positioned with respect to the prior driven joint 109*a*, welded thereto, and driven by the hammer 67 to the level of upper deck 101, whereupon, the aforedescribed sequence is repeated. It may be visualized that the sequence of joints comprising 109, 109*a*, 109*b* (not shown) and so forth are driven to depth a residual length of joint will protrude above the surface 111 of the water. In order to then attach a Christmas tree or other production equipment to the pipe at the level of the lower deck where such production equipment commonly resides, the residual length of the pipe above the lower deck is necessarily cut off and removed. This step is necessary because the pile driving hammer 67 can operate only to the level of the upper deck 101.

As shown in FIG. 8, there is provided in the upper deck 101 a sufficient opening 113 through which the knuckle lead is able to move not only vertically but with some reasonable degree of lateral freedom. A diaphragm buffer may be provided in the opening. The opening is of sufficient size to allow passage of the knuckle lead and hammer therethrough. When the upper level of the joint has been driven to the level of the upper deck, hammering may continue by lowering the knuckle lead through opening 113 and by so doing the joint 109 may be driven down to or beneath the level of the lower deck 105. In fact, the end of joint 109 can be driven to any desired level above the surface 111 of the water and within the limits of the travel of knuckle lead 31. Thus, the surplus step of having to cut off the residual length of joint, after depth has been reached, due to the inability of the hammer to operate beneath the level of the upper deck, is avoided and substantial savings in time and money are achieved. Moreover, operation of the hammer at the level of the lower deck or below allows for utilization of longer length of pipe joint and hence savings in time taken for welding joints of pipe together and savings in time normally taken for cutting joints, all of which results in substantial improvement in the economics of hammering operations.

Figure 2:
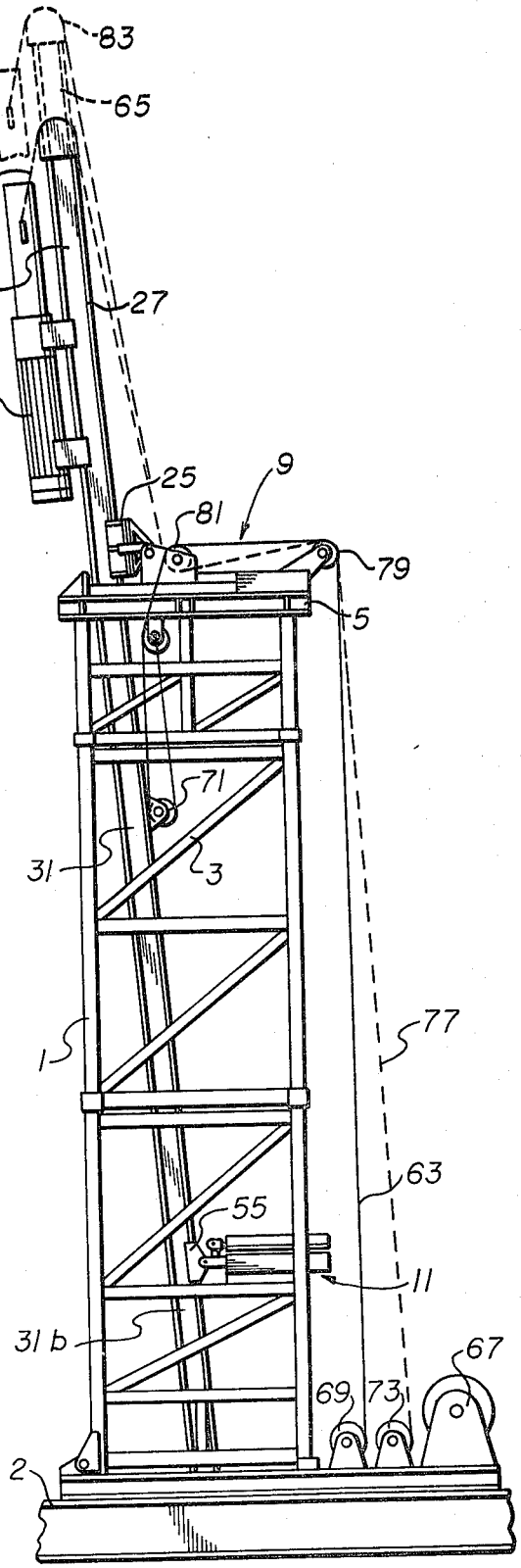
FIG. 2 is a side view of the pile driving rig showing the hammer and knuckle lead in a second operating position at a negative angle of batter.
Figure 3:
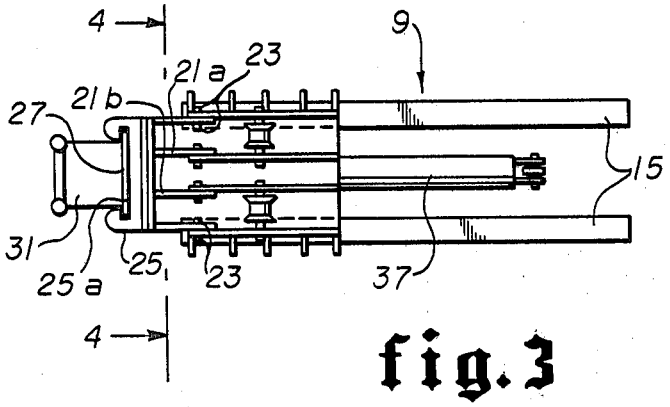
FIG. 3 is a top view of the upper kicker along the plan 3—3 of FIG. 1.

From the foregoing, it will be recognized that the pile driving rig of movable character as described in the afore-mentioned preceding Application, when characterized by the universally angulating knuckle lead disclosed herein, possesses market opportunity for the economic operations of driving a pattern of pile or conductor pipe in an offshore environment. By moving the pile driving rig on the skids to predetermined positions on the platform, the pile driving functions become readily accomplished without cumbersome movement of derrick barges. Likewise, the elimination of a drill rig for such preliminary operations becomes advantageous. Substitution of the pile driving rig therefor for the derrick barge and drill rig produces market savings because of the substantial costs otherwise incurred. Moreover, and further in accordance with the principles of this invention, the utilization of the universally angulating knuckle lead mounted within the pile driving rig and supported thereby for angularly positioning a diesel or other hammer means significantly increases the versatility of the already mobile and cost saving pile driving rig. The knuckle lead assembly, including the upper and lower kicker means 9, 11 enables movement of the lead at varying angles from the vertical both at the top and bottom thereof, thus substantially increasing the range of arcuate disposition from the vertical and enabling hammering operations to take place at extreme angles of inclination. Moreover, utilization of both the upper and lower kicker assembly within a vertically fixed structural tower or rig avoids the need for external draw works for tilting of the rig in order to achieve inclination of the knuckle lead 31. Furthermore, utilization of the upper kicker means 9 and lower kicker means 11 in conjunction with their respective slide means 25, 55, provides for the advantageous movement of the knuckle lead to elevated positions in order to vertically place pile sections or the like beneath the hammer preparatory to welding pipe sections and hammering. Thus, it will be visualized that the draw works 63, see FIG. 2 for example, can be operated to raise the knuckle lead to the substantial elevated position, this being in the range of up to the level of the lower kicker assembly 11, thus permitting concomitant raising of the hammer 67; see the elevated position of the knuckle lead in Ghost 65, (FIG. 2). Therefore, operation of the motor 67 drives winding drum 69 to either raise or lower knuckle lead 31 by reason of the sledded path of the draw works 63 around pulley 71 which is structurally attached to the knuckle lead. Elevation of the knuckle lead enables elevation of the hammer 67 to the position illustrated in Ghost in FIG. 2. Shifting of the motor 67 to operate winding drum 73 results in elevational movement of hammer 67 along the track of knuckle lead 31 by reason of the threaded path of hammer cable 77 about pulleys 79, 81 and 83.

An advantageous embodiment of the invention has been shown and described. It will be obvious to those skilled in the art that various changes and modifications may be made therein without departing from the spirit and scope thereof as set forth in the appended claims.

Therefore, that which is claimed and desired to be secured by U.S. Letters Patent is:

1. In a pile driving rig for use in driving pipe and anchoring pile elements and the like in a preselected position or pattern in the ground below the surface of a body of water comprising the combination of a supporting platform having track means thereon for supporting the pile driving rig and providing for selective movement of the rig to the position of the pipe or pile to be hammered, upper and lower kicker means structurally affixed to the rig having extensible and retractable means pivotally coupled to respective first and second slide means at the ends thereof, a knuckle lead disposed substantially vertically adjacent the rig engaged by said slide means respectively proximate the upper and lower end thereof, a pulley structurally affixed to said knuckle lead between said first and second slide means receiving thereabout a draw works cable for selectively raising or lowering the knuckle lead so as to enable positioning of a raised pipe or pile section in substantial vertical position therebeneath and for enabling increased range of hammer stroke on the knuckle lead with respect to said raised pipe or pile section while simultaneously providing for controlled arcuate movement of the knuckle lead both above and below an axial position intermediate the upper and lower kicker means so as to align the knuckle lead in a vertical or fore or aft slope position with the pipe or pile.

2. The combination of claim 1 including further a hammer means suspended on said knuckle lead by a hammer cable selectively movable on said knuckle lead through the substantial length thereof when the knuckle lead is in either its lowest or hightest position with respect to the pile driving rig.

3. The combination of claim 2 wherein said upper kicker means pivotal connection is characterized by a plurality of trunnion plates having a bore therethrough coupled to the extensible and retractable means, a yoke plate fixedly attached to the slide means having a horizontally disposed bore therethrough in aligned position with the bore of said trunnion plates, and a pin in said bores providing for pivotal movement of said slide means when the knuckle lead is caused to be pivoted about said pin upon actuation of the lower kicker assembly.

4. The combination of claim 3 wherein said upper kicker means is characterized further by a support means forming the structural connection with the rig adjacent the top thereof so as to thereby maximize the distance of arc travel of the knuckle lead at the bottom thereof due to the largest pivot radius from the pivot pin.

5. The combination of claim 4 wherein said upper and lower kicker means are each characterized by movement capabilities both fore and aft of a vertical center line between their respective slide means thus providing for maximum positive slope of the lead when the upper kicker assembly is fully withdrawn and the lower kicker assembly is fully extended and maximum negative slope when the lower kicker assembly is fully withdrawn and the upper kicker assembly is fully extended.

6. The combination of a pile driving tower independently established on an offshore structure in which the tower is adapted to receive and support pile driving means for vertically and angularly driving pipe and anchoring pile elements, the tower being vertically fixed but slidably movable from the surface of the structure so as to drive pipe and/or pile in a preselected angle and position without the need for a derrick barge, drill rig or boom type crane, the improvement comprising a knuckle lead affixed to the tower adjacent the upper and lower ends thereof by upper and lower kicker means for moving the lead fore and aft of a vertical center line bisecting a pivotal coupling to both kicker means, each kicker means being movable independently of the other to a position either fore or aft of the center line to thereby position the knuckle lead at either positive or negative extreme angles of inclination and thereby providing a wide and versatile range of driving capabilities to the hammer which is carried thereon, and means for moving the knuckle lead upwardly or downwardly independently of movement fore and aft imparted by said upper and lower kicker means.

7. The combination of claim 6 wherein the said kicker means are independently controlled from remote position therefrom and said means for moving upwardly or downwardly, including a draw works operatively connected to said knuckle lead for vertical positioning thereof with respect to the end of a section of pile or pipe thus providing high and low angles of batter either proximate to the water or above the deck of the offshore structure.

8. On an offshore platform used to explore for and retrieve oil and gas from beneath the surface of a body of water the improvement comprising the combination of a mobile tower movable thereon from one preselected position to another for cooperatively moving and supporting a pile driving hammer for battering a pipe and/or pile;

a vertically disposed knuckle lead for supporting the hammer and means coupling the knuckle lead to the tower for moving the knuckle lead fore and aft of the vertical at either the upper or the lower end thereof without movement of the supporting tower to thereby achieve and facilitate positive and negative angles of batter.

9. On an offshore platform used to explore for and retrieve oil and gas from beneath the surface of a body of water having a mobile tower movable thereon from one preselected position to another for cooperatively moving and supporting a pile driving hammer for battering pipe and/or pile, the improvement comprising:

an opening in the deck of the offshore platform of sufficient size to permit movement of an operating pile driving hammer therethrough, a movably disposed knuckle lead means operatively supported by said mobile tower extending through said opening for carrying the hammer into operative battering contact with pile or pipe above or beneath the level of the deck on which the tower is supported for reducing, cutting and welding operations on the pipe or pile and thereby effecting economic savings in driving operations, and kicker means proximate the upper and lower ends of said knuckle lead for adjusting the angular position of the knuckle lead and hammer and hence hammer movement with respect to the mobile tower.

10. The combination of claim 9 wherein said movable knuckle lead means includes a draw works operatively connected thereto for vertically positioning the knuckle lead with respect to the end of a section of pile or pipe beneath the level of the deck supporting the tower and thus providing high and low angles of batter either proximate to the water or above the deck supporting the tower.

11. In a pile driving rig for use in driving pipe and anchoring pile elements and the like in a preselected position or pattern in the ground below the surface of a body of water comprising the combination of a supporting platform having tract means thereon for supporting the pile driving rig and providing for selective movement of the rig to the position of the pipe or pile to be hammered, upper and lower kicker means structurally affixed to the rig having extensible and retractable means pivotally coupled to respective first and second slide means at the ends thereof, a knuckle lead disposed substantially vertically adjacent the rig engaged by said slide means respectively proximate the upper and lower end thereof, a pulley structurally affixed to said knuckle lead between said first and second slide means receiving thereabout a draw works cable for selectively raising or lowering the knuckle lead so as to enable positioning of a raised pipe or pile section in substantial vertical position therebeneath and for enabling increased range of hammer stroke on the knuckle lead with respect to said raised pipe or pile section while simultaneously providing for controlled arcuate movement of the knuckle lead both above and below an axial position intermediate the upper and lower kicker means so as to align the knuckle lead in a vertical or fore or aft slope position with the pipe or pile, a hammer means suspended on said knuckle lead by a hammer cable selectively moveable on said knuckle lead through the substantial length thereof when the knuckle lead is in either its lowest or highest position with respect to the pile driving rig, said upper kicker means pivotal connection being characterized by a plurality of trunnion plates having a bore therethrough coupled to the extensible retractable means, a yoke plate fixedly attached to the slide means having a horizontally disposed bore therethrough in aligned position with the bore of said trunnion plates, and a pin in said bores providing for pivotal movement of said slide means when the knuckle lead is caused to be pivoted about said pin upon actuation of the lower kicker assembly.

12. The combination of claim 11 wherein said upper kicker means is characterized further by a support means forming the structural connection with the rig adjacent the top thereof so as to thereby maximize the distance of arc travel of the knuckle lead at the bottom thereof due to the largest pivot radius from the pivot pin.

13. The combination of claim 12 wherein said upper and lower kicker means are each characterized by movement capabilities both fore and aft of a vertical center line between their respective slide means thus providing for maximum positive slope of the lead when the upper kicker assembly is fully withdrawn and the lower kicker assembly is fully extended and maximum negative slope when the lower kicker assembly is fully withdrawn and the upper kicker assembly is fully extended.

14. On an offshore platform used to explore for and retrieve oil and gas from beneath the surface of a body of water, the combination comprising:

a mobile tower movable on said offshore platform from one preselected position to another for cooperatively moving and supporting a pile driving hammer for battering pipe and/or pile, an opening in the deck of the offshore platform of sufficient size to permit movement of said operating pile driving hammer therethrough, a knuckle lead means for carrying said pile driving hammer operatively supported by said mobile tower and movably extensible through said opening for carrying the hammer into operative contact with said pile or pipe beneath the level of the deck on which the tower is supported without movement of the supporting tower, and said knuckle lead means being movable fore and aft of the vertical at either the upper or lower ends thereof to thereby achieve and facilitate positive and negative angles of batter and for effecting economic savings in driving operations.

* * * * *